US010224645B2

(12) United States Patent
Rao et al.

(10) Patent No.: US 10,224,645 B2
(45) Date of Patent: Mar. 5, 2019

(54) SMART ANTENNA SYSTEM FOR ACHIEVING CIRCULARLY POLARIZED AND ELECTRICALLY DOWNTILTED PHASED ARRAY SIGNALS

(71) Applicant: Signalchip Innovations Private Limited, Bengaluru (IN)

(72) Inventors: Nikhil Birur Gururaja Rao, Chikballapur (IN); Himamshu Gopalakrishna Khasnis, Bengaluru (IN); Sachin Madhukar Dhareshwar, Bengaluru (IN)

( * ) Notice: Subject to any disclaimer, the term of this patent is extended or adjusted under 35 U.S.C. 154(b) by 220 days.

(21) Appl. No.: 15/459,522

(22) Filed: Mar. 15, 2017

(65) Prior Publication Data

US 2017/0271781 A1 Sep. 21, 2017

(30) Foreign Application Priority Data

Mar. 15, 2016 (IN) ..... 201641009006

(51) Int. Cl.
*H01Q 21/22* (2006.01)
*H01Q 9/04* (2006.01)
*H01Q 3/26* (2006.01)

(52) U.S. Cl.
CPC ..... *H01Q 21/22* (2013.01); *H01Q 3/26* (2013.01); *H01Q 9/0428* (2013.01)

(58) Field of Classification Search
CPC ..... H01Q 1/246; H01Q 21/08; H01Q 21/22; H01Q 21/30; H01Q 23/00; H01Q 25/00; H01Q 3/26; H01Q 3/2605; H01Q 1/523; H04W 16/24; H04W 16/28; H04W 84/14; H04W 88/085
USPC ..... 455/63.4
See application file for complete search history.

(56) References Cited

U.S. PATENT DOCUMENTS

2008/0007453 A1* 1/2008 Vassilakis ..... H01Q 1/246 342/368

* cited by examiner

*Primary Examiner* — Shaima Q Aminzay
(74) *Attorney, Agent, or Firm* — The Law Office of Austin Bonderer, PC; Austin Bonderer

(57) ABSTRACT

A smart antenna system for achieving circularly polarized and electrically down tilted phased array signal is provided. The baseband transmitter transmits a baseband signal. The first voltage controlled oscillator (a) modulates the baseband signal to a plurality of phase shifted intermediate frequency signals, and the second voltage controlled oscillator (b) modulates the plurality of phase shifted intermediate frequency signals to a plurality of phase shifted radio frequency signals. The plurality of power amplifiers amplify the plurality of phase shifted radio frequency signals. The plurality of antennas radiate the plurality of phase shifted radio frequency signals for generating the phased array signals. The phased array signals achieve (i) tilting of an antenna radiation plane of the plurality of antennas from an initial position to a tilted position and (ii) transmitting the plurality of phase shifted radio frequency signals in a circular polarization.

14 Claims, 6 Drawing Sheets

SMART ANTENNA SYSTEM FOR ACHIEVING CIRCULARLY POLARIZED AND ELECTRICALLY DOWNTILTED PHASED ARRAY SIGNALS

CROSS-REFERENCE TO RELATED APPLICATIONS

This application claims priority to Indian patent application no. 201641009006 filed on Mar. 15, 2016, the complete disclosure of which, in its entirely, is herein incorporated by reference.

BACKGROUND

Technical Field

The embodiments herein generally relate to a phased array antenna, and more particularly, to a method of transmitting circularly polarized signals while providing a down tilt by using local oscillator phase shifting technique.

Description of the Related Art

Phased array antennas operate on the principle that different phases of the signal obtained using phase shifters are fed to different radiating elements in the antenna array to steer the beam in the required direction. A phased array antenna will have in general 'N' number of radiating elements. Each element will receive a signal having phase related to the direction in which transmit the beam that needs to be steered. A down tilt is necessary to the radiated beam to give proper coverage to areas close to the antenna and also not to interfere with other cell arrays. An electrical down tilt is better than a mechanical down tilt as the tilt can be easily programmed if it is electrical. If it is mechanical, then the antenna has to be manually tilted making use of motors or hinges.

Accordingly, there remains a need for a system and a method for achieving circular polarization and electrical down tilt using multiple phases of the local oscillator clock of a super heterodyne receiver.

SUMMARY

In view of a foregoing, an embodiment herein provides a smart antenna system for generating circularly polarized and electrically down tilted phased array signals is provided. The smart antenna system includes a baseband transmitter, a first voltage controlled oscillator (VCO), a plurality of power amplifiers and a plurality of antennas. The baseband transmitter transmits a baseband signal. The first voltage controlled oscillator (VCO) generates at least one of a plurality of phase shifted local oscillator (LO) signals which modulates the baseband signal to a plurality of phase shifted intermediate frequency (IF) signals. The plurality of phase shifted intermediate frequency signals further modulated to a plurality of phase shifted radio frequency (RF) signals using a plurality of local oscillator (LO) signals generated by a second voltage controlled oscillator. The first voltage controlled oscillator (VCO) further generates a plurality of phase shifted local oscillator (LO) signals which modulate the baseband signal directly to the plurality of phase shifted radio frequency signals. The plurality of power amplifiers that amplifies the plurality of phase shifted radio frequency signals. The plurality of antennas that radiate the plurality of phase shifted radio frequency signals for generating the phased array signals. The phased array signals achieve (i) tilting of an antenna radiation plane of the plurality of radiating antennas from an initial position to a tilted position and (ii) transmitting the plurality of phase shifted radio frequency signals in a circular polarization.

In one embodiment, the circular polarization is achieved by (i) arranging a plurality of first phase array radiating elements in a horizontal plane in addition to a plurality of second phase array radiating elements in a vertical plane and (ii) feeding individual radiating elements of the plurality of first phase array radiating elements with exactly 90 degree phase shifted clocks with respect to the plurality of second phase array radiating elements.

In another embodiment, the phased array signals (i) provide proper coverage to areas close to the plurality of antennas and (ii) provide the down tilt for the antenna radiation plane to avoid interference between signals with other cell arrays.

In yet another embodiment, the first voltage controlled oscillator (VCO) generates multiple phases of the plurality of phase shifted LO signals and the second voltage controlled oscillator generates the plurality of LO signals. The multiple phases of the plurality of phase shifted LO signals from the first VCO modulate the baseband signal to generate at least one of (i) the plurality of phase shifted intermediate frequency signals and the plurality of phase shifted intermediate frequency signals further modulated to the plurality of radio frequency signals using the plurality of LO signals generated by the second VCO or (ii) the plurality of phase shifted radio frequency signals. The multiple phases further include the quadrature clocks that are generated in the first voltage controlled oscillator.

In yet another embodiment, the first voltage controlled oscillator (VCO) and the second voltage controlled oscillator are either at least one of (i) a ring oscillator voltage controlled oscillator or (ii) an inductance-capacitance (LC) voltage controlled oscillator.

In yet another embodiment, the ring oscillator voltage controlled oscillator includes a plurality of rings which are oscillating at fixed phase differences with respect to each other to generate the plurality of local oscillator (LO) signals that are phase shifted.

In yet another embodiment, the antenna radiation plane is tilted using an electrical down tilt. The electrical down tilt is a programmable tilt. The electrical down tilt is achieved by programming the phase difference between (i) the plurality of phase shifted intermediate frequency signals or (ii) the plurality of phase shifted radio frequency signals that are sent to the second phase array radiating elements.

In one aspect, a smart antenna system for generating circularly polarized and electrically down tilted phased array signals is provided. The smart antenna system includes a baseband transmitter, a first voltage controlled oscillator (VCO), a plurality of power amplifiers and a plurality of antennas. The baseband transmitter transmits a baseband signal. The first voltage controlled oscillator (VCO) generates of at least one of: (a) a plurality of first clocks or (b) a plurality of clocks. The plurality of first clocks are phase shifted which modulates the baseband signal to a plurality of phase shifted intermediate frequency signals. The plurality of phase shifted intermediate frequency signals further modulated to a plurality of phase shifted radio frequency (RF) signals using a plurality of second clocks that is generated by a second voltage controlled oscillator. The plurality of clocks are phase shifted which modulates the baseband signal directly to the plurality of phase shifted radio frequency signals. The plurality of power amplifiers amplifies a plurality of phase shifted radio frequency signals. The plurality of antennas radiates the plurality of phase shifted radio frequency signal for generating the phased array signals. The phased array signals achieve (i) tilting of an antenna radiation plane of the plurality of antennas from an initial position to a tilted position, and (ii) transmitting the plurality of phase shifted radio frequency signals in a circular polarization. The antenna radiation plane is tilted using an electrical down tilt. The electrical down tilt is a programmable tilt. The electrical down tilt is achieved by programming the phase difference between (i) the plurality of phase shifted intermediate frequency signals or (ii) the plurality of phase shifted radio frequency signals that are sent to a plurality of second phased array radiating elements.

In one embodiment, the circular polarization is achieved by (i) arranging a plurality of first phase array radiating elements in a horizontal plane in addition to the plurality of second phase array radiating elements in a vertical plane and (ii) feeding individual radiating elements of the plurality of first phase array radiating elements with exactly 90 degree phase shifted clocks with respect to the plurality of second phase array radiating elements.

In another embodiment, the second voltage controlled oscillator includes a plurality of second clocks. The plurality of second clocks modulates the plurality of phase shifted intermediate frequency signals to the plurality of phase shifted radio frequency signals.

In another aspect, a method for generating circularly polarized and electrically down tilted phased array signals is provided. The method includes the steps of: (i) transmitting, using a baseband transmitter, a baseband signal; (ii) generating, using a first voltage control oscillator (VCO), at least one of (i) a plurality of first clocks that are phase shifted which modulates the baseband signal to a plurality of phase shifted intermediate frequency signals, wherein the plurality of phase shifted intermediate frequency signals are further modulated to a plurality of phase shifted radio frequency (RF) signals using a plurality of second clocks that is generated by a second voltage controlled oscillator or (ii) a plurality of clocks that are phase shifted which modulates the baseband signal directly to the plurality of phase shifted radio frequency signals; (iii) amplifying, using a plurality of power amplifiers, the plurality of phase shifted radio frequency signals; (iv) transmitting, using a plurality of antennas, the plurality of phase shifted radio frequency signals in a circular polarization; and (vii) tilting, using an electrical tilt down, an antenna radiation plane of the plurality of antennas using the phased array signals. The phased array signals (i) provide proper coverage to areas close to the plurality of antennas and (ii) provide the down tilt for the antenna radiation plane to avoid interference between signals with other cell arrays.

In one embodiment, the method further includes the steps of: (i) arranging a plurality of first phase array radiating elements in a horizontal plane in addition to a plurality of second phase array radiating elements in a vertical plane; and (ii) feeding individual radiating elements of the plurality of first phase array radiating elements with exactly 90 degree phase shifted clocks with respect to the plurality of second phase array radiating elements to achieve the circular polarization.

In another embodiment, the first voltage controlled oscillator and the second voltage controlled oscillator are either at least one of (i) a ring oscillator voltage controlled oscillator or (ii) an inductance-capacitance (LC) voltage controlled oscillator.

In yet another embodiment, the ring oscillator voltage controlled oscillator includes a plurality of rings that oscillate at fixed phase differences with respect to each other to generate multiple phases of a plurality of phase shifted local oscillator (LO) signals.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1A:
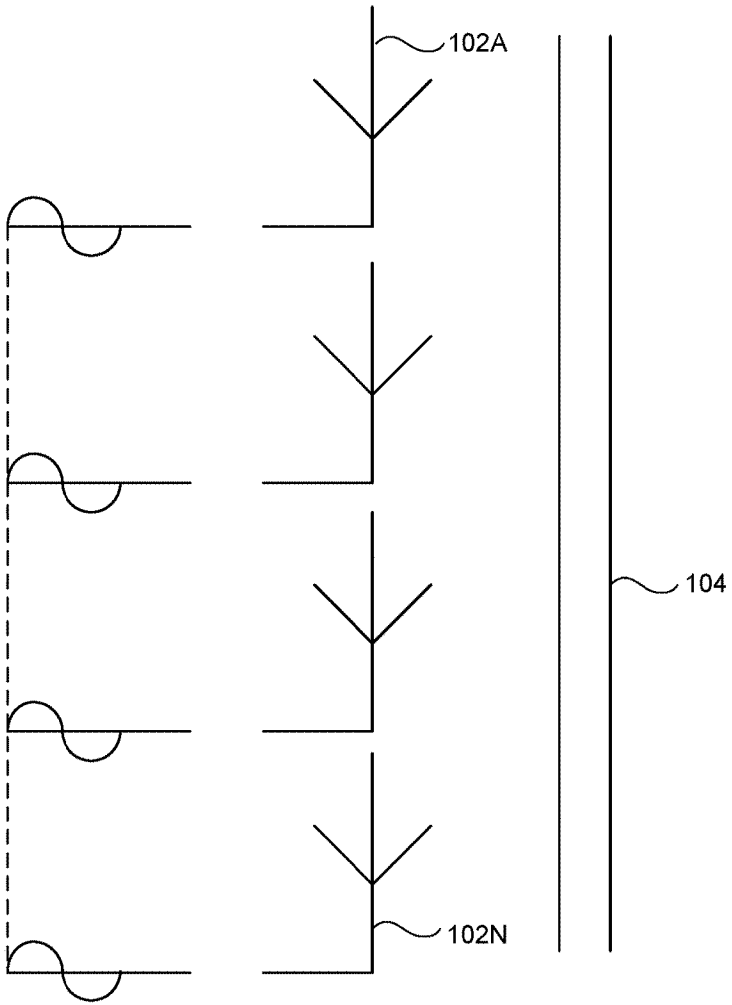
FIGS. 1A-1B illustrate schematic illustrations of feeding phase shifted signals to a plurality of antennas to obtain a down tilt according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein. Referring now to the drawings and more particularly to FIGS. 1A through 4, where similar reference characters denote corresponding features consistently throughout the figures, there are shown preferred embodiments.

Figure 1B:
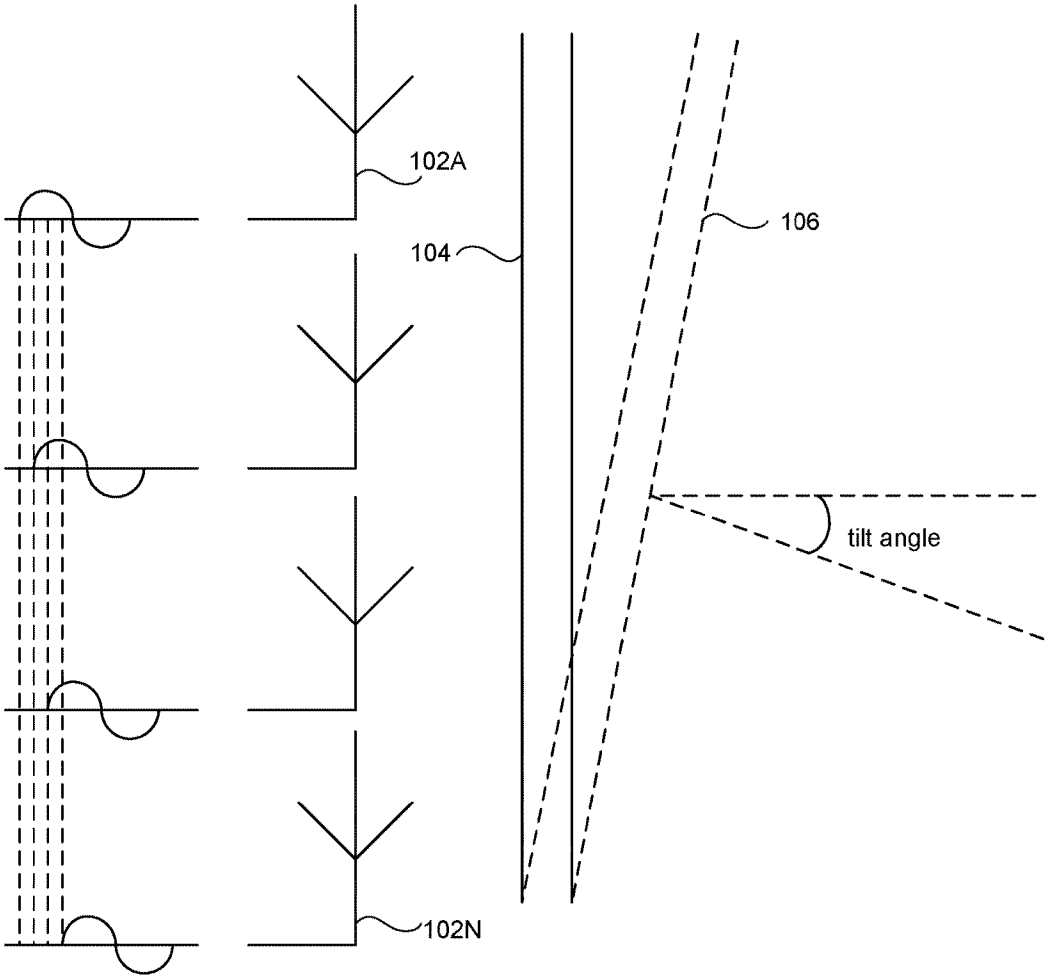

FIGS. 1A-1B illustrate schematic illustrations of feeding phase shifted signals to a plurality of antennas to obtain a down tilt according to an embodiment herein. The schematic illustration includes a plurality of antennas 102A-N, an antenna radiation plane, and a tilted antenna radiation plane. In one embodiment, FIG. 1A illustrates the antenna radiation plane in an initial position 104 which does not have any tilt (e.g. down tilt) with respect to the plane of phased array signals when all individual radiating elements are fed with same phase signals. In another embodiment, FIG. 1B illustrates the antenna radiation plane that is tilted from the initial position 104 to a tilted position 106 in which all the radiating elements are fed with phase shifted signals. The antenna radiation plane in the tilted position 106 (e.g. the down tilt)

with respect to the plane of the phased array signals. The phased array signals provide (i) proper coverage to areas close to the plurality of antennas 102A-N and (ii) down tilt for the antenna radiation plane to avoid interference between signals with other cell arrays. The plurality of antennas 102A-N is tilted from the initial position 104 to the tilted position 106 (as depicted in FIG. 1B) using a programmable electrical down tilt.

Figure 2:
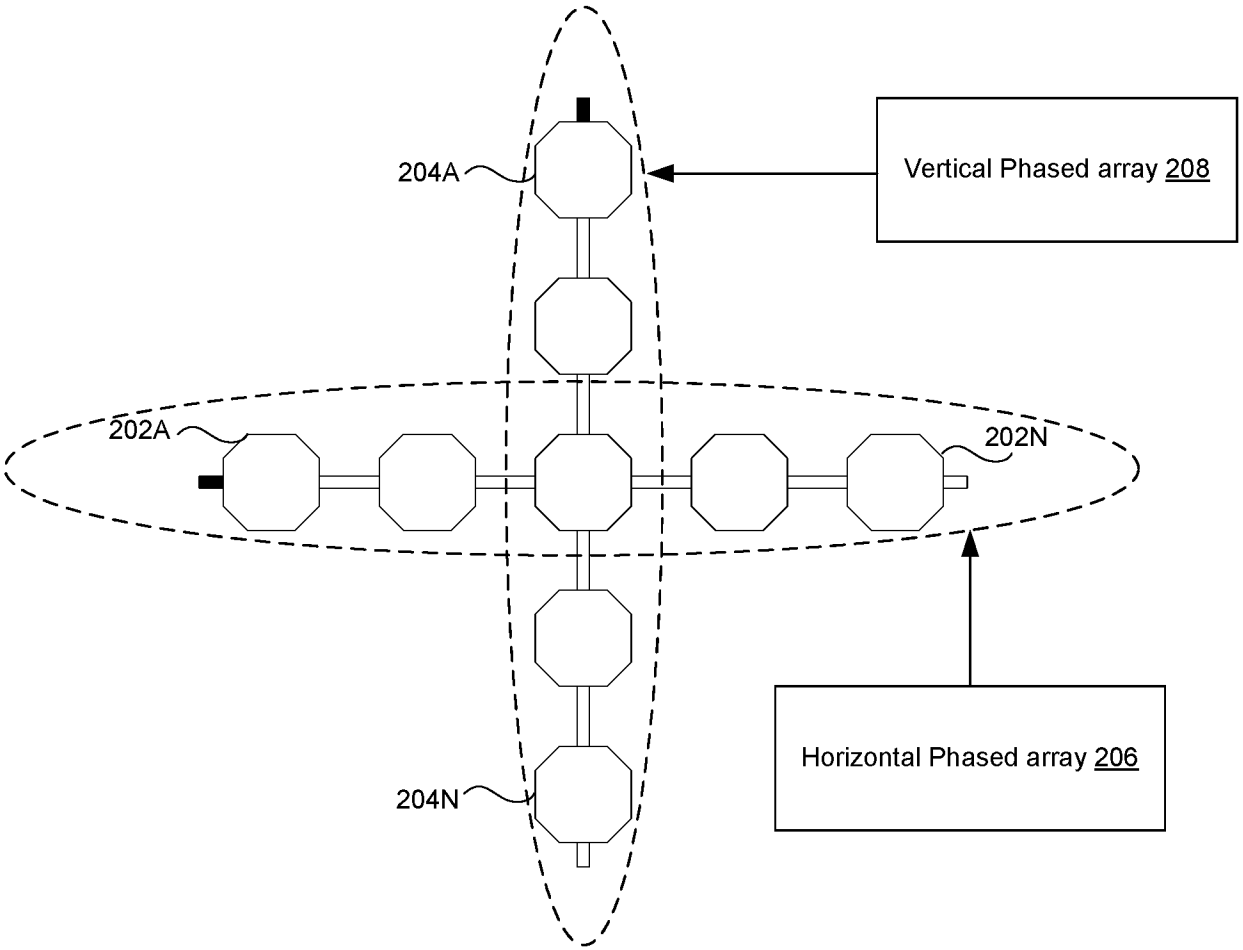
FIG. 2 illustrates a structural arrangement of a plurality of radiating elements of a plurality of antennas to achieve circular polarization according to an embodiment herein.

FIG. 2 illustrates a structural arrangement of a plurality of radiating elements of the plurality of antennas 102A-N to achieve circular polarization according to an embodiment herein. The structure includes a horizontal phased array 206 and a vertical phased array 208. The horizontal phased array 206 includes a plurality of horizontal phase array radiating elements 202A-N in a horizontal plane. In one embodiment, the plurality of horizontal phase array radiating elements 202A-N are mentioned as a plurality of first phase array radiating elements. The vertical phased array 208 includes a plurality of vertical phase array radiating elements 204A-N in a vertical plane. In an embodiment, the plurality of vertical phase array radiating elements 204A-N are mentioned as a plurality of second phase array radiating elements. There are disadvantages in receiving signals which are linearly polarized as maximum signal and is received only if the receiver plane is the same as the polarization plane. No such restrictions to receiver position are necessary if the transmitted signal is circularly polarized. The plurality of first phase array radiating elements 202A-N radiates a horizontal phase array signal. The plurality of second phase array radiating elements 204A-N radiates a vertical phase array signal. The circular polarization includes the horizontal phase array signal and the vertical phase array signal.

The circular polarization is achieved by (i) arranging the plurality of first phase array radiating elements 202A-N in the horizontal plane in addition to the plurality of second phase array radiating elements 204A-N in the vertical plane, (ii) feeding the individual radiating elements of the plurality of first phase array radiating elements 202A-N with exactly 90 degree phase shifted clocks with respect to the plurality of second phase array radiating elements 204A-N.

Figure 3A:
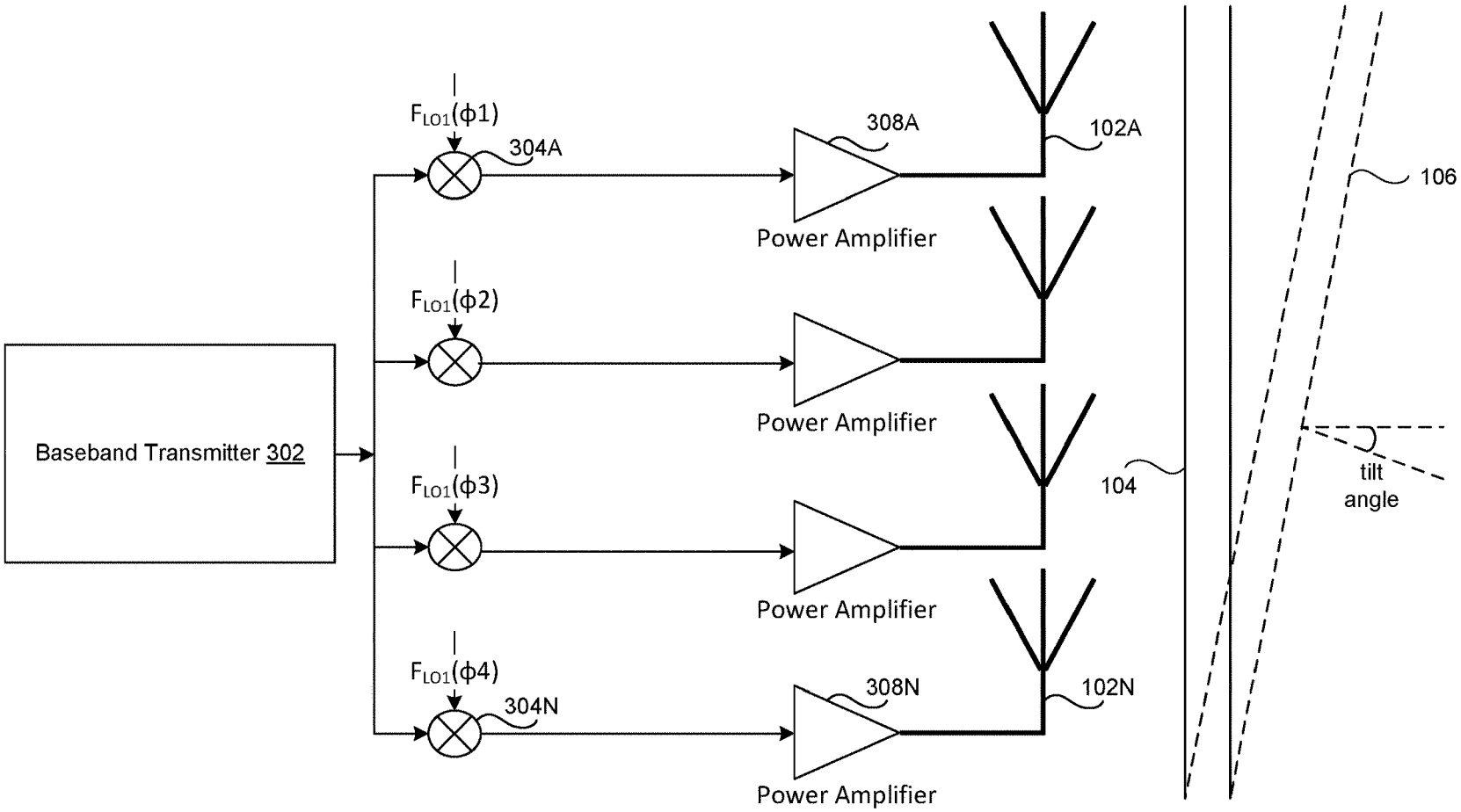
FIGS. 3A-3B illustrate a system for generating phased array signals according to an embodiment herein.
Figure 3B:
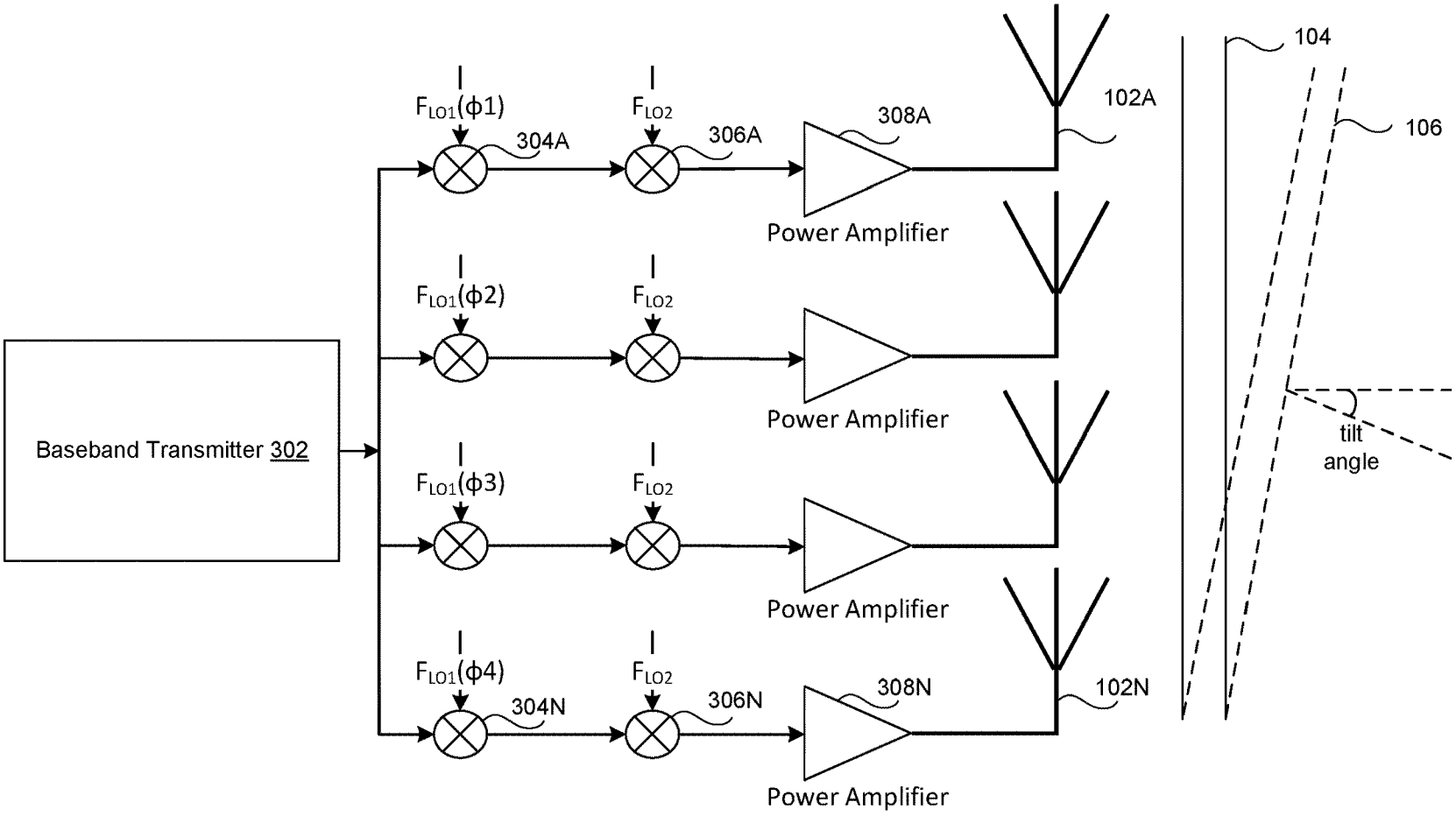

FIGS. 3A-3B illustrate a system for generating phased array signals according to an embodiment herein. The system includes a baseband transmitter 302, a plurality of a first clocks 304A-N, a plurality of second clocks 306A-N, a plurality of power amplifiers 308A-N, and a plurality of antennas 102A-N. The baseband transmitter 302 transmits a baseband signal. The plurality of first clocks 304A-N is generated as output by a first voltage control oscillator (VCO). The plurality of second clocks 306A-N is generated as output by a second voltage control oscillator (VCO) (as shown in FIG. 3B). In one embodiment, a plurality of phase shifted local oscillator (LO) signals is generated by the first voltage control oscillator (VCO). In another embodiment, the plurality of local oscillator (LO) signals is generated by the second voltage control oscillator (VCO). The plurality of first clocks 304A-N are phase shifted which (a) modulate the baseband signal to a plurality of phase shifted intermediate frequency (IF) signals and the plurality of second clocks 306A-N (as shown in FIG. 3B) modulates the plurality of phase shifted intermediate frequency signals to the plurality of phase shifted radio frequency signals. In one embodiment, the plurality of first clocks 304A-N are phase shifted which modulate the baseband signal directly to the plurality of phase shifted radio frequency (RF) signals (as shown in FIG. 3A). In one embodiment, the first voltage control oscillator (VCO) and the second voltage control oscillator is at least one of (i) a ring oscillator voltage control oscillator or (ii) an inductance-capacitance (LC) voltage controlled oscillator. The plurality of power amplifiers 308A-N amplifies the plurality of phase shifted radio frequency signals. The first VCO generate multiple phases of the plurality of phase shifted LO signals. In an embodiment, the multiple phases include quadrature clocks that are generated in the voltage controlled oscillator. In an embodiment, the multiple phases of the plurality of phase shifted LO signals from first VCO modulate the baseband signal to generate at least one of (i) the plurality of phase shifted intermediate frequency signals which further gets modulated to the plurality of radio frequency signals using the plurality of LO signals from the second VCO (as depicted in FIG. 3B) or (ii) the plurality of phase shifted radio frequency signals (as depicted in FIG. 3A).

In one embodiment, the ring oscillator voltage controlled oscillator includes a plurality of rings that oscillate at fixed phase differences with respect to each other to generate multiple phases of a plurality of phase shifted local oscillator signals as required. The plurality of antennas 102A-N radiates the plurality of phase shifted radio frequency signals in the circular polarization. The antenna radiation plane of the plurality of antennas 102A-N is tilted from the initial position 104 to the tilted position 106 using a programmable electrical down tilt. In one embodiment, the down tilt is an electrical down tilt. The electrical down tilt is achieved by programming the phase difference between (i) the plurality of phase shifted intermediate frequency signals or (ii) the plurality of phase shifted radio frequency signals that are sent to the plurality of second phase array radiating elements 204A-N.

The Programmable Electrical down tilt may be achieved by choosing one or more phases among the many phases of the ring oscillator VCO. In yet another embodiment, based on the chosen phases, their quadrature clocks should be fed to the plurality of first phase array radiating elements 202A-N to achieve perfect circular polarization with respect to the plurality of second phase array radiating elements 204A-N.

Figure 4:
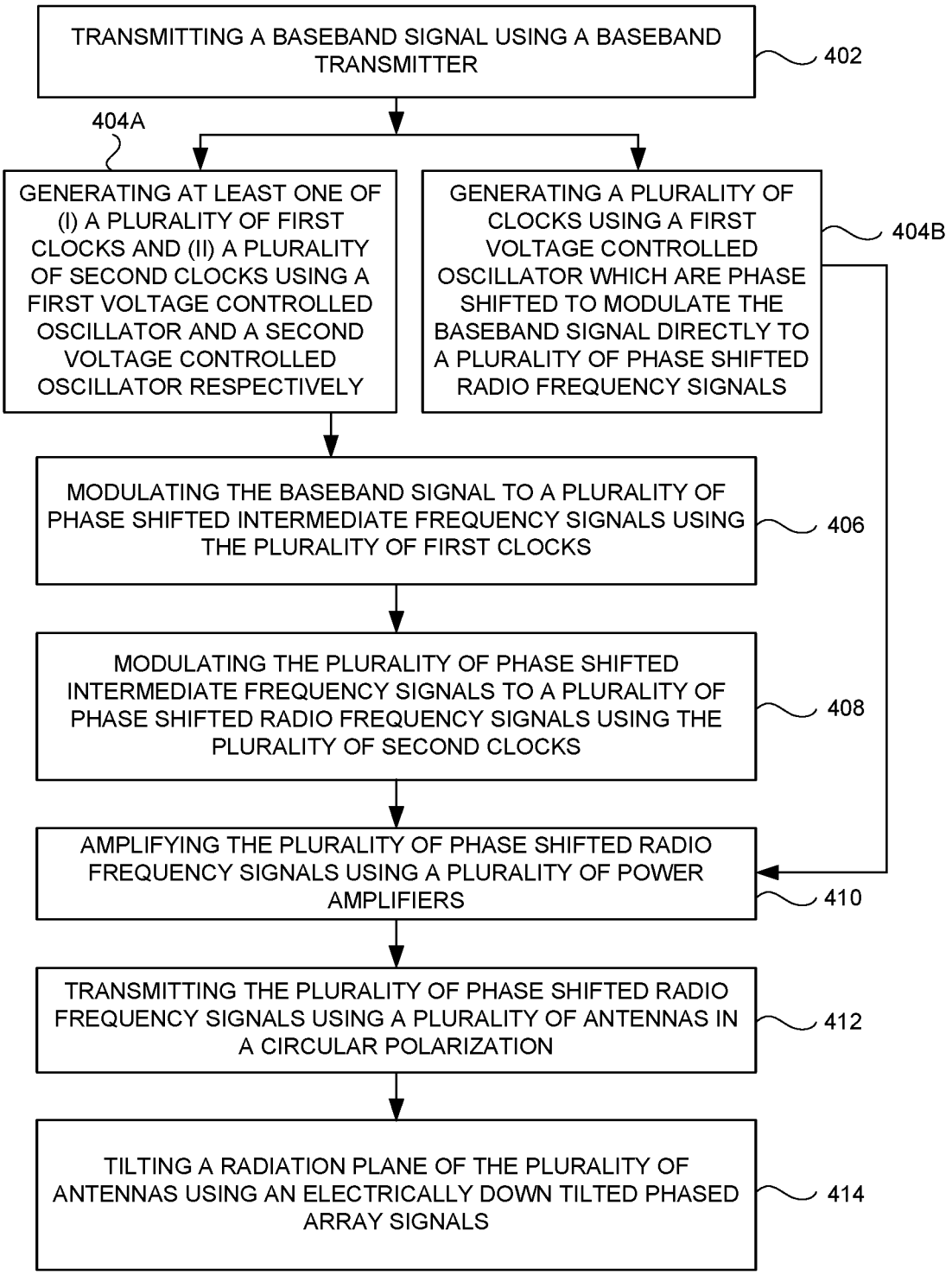
FIG. 4 is a flow diagram illustrating a method to generate phased array signals for achieving circular polarization and electrical down tilt using the plurality of antennas according to an embodiment herein.

FIG. 4 is a flow diagram illustrating a method to generate phased array signals for achieving circular polarization and electrical down tilt using the plurality of antennas 102A-N according to an embodiment herein. At step 402, a baseband signal is transmitted using a baseband transmitter 302. At step 404A, (i) a plurality of first clocks 304A-N and (ii) a plurality of second clocks 306A-N are generated by a first voltage controlled oscillator and a second voltage controlled oscillator respectively. The plurality of first clocks 304A-N are phase shifted. At step 404B, a plurality of clocks is generated using the first voltage controlled oscillator. The plurality of clocks is phase shifted which modulates the baseband signal directly to the plurality of phase shifted radio frequency signals. At step 406, the baseband signal is modulated to a plurality of phase shifted intermediate frequency signals using the plurality of first clocks 304A-N. At step 408, the plurality of phase shifted intermediate frequency signals are modulated to the plurality of phase shifted radio frequency signals using the plurality of second clocks 306A-N. At step 410, the plurality of phase shifted radio frequency signals are amplified using a plurality of power amplifiers 308A-N. In one embodiment, the plurality of power amplifiers 308A-N receives the plurality of phase shifted radio frequency signals directly from the step 404B to amplify the plurality of phase shifted radio frequency signals. At step 412, the plurality of phase shifted radio frequency signals are transmitted using a plurality of antennas 102A-N in a circular polarization. At step 414, the phased array signals tilt the radiation plane of the plurality of antennas 102A-N by achieving an electrical down tilt and circular polarization.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims

What is claimed is:

1. A smart antenna system for generating circularly polarized and electrically down tilted phased array signals, comprising:

a baseband transmitter that transmits a baseband signal;

a first voltage controlled oscillator (VCO) which generates at least one of (a) a plurality of phase shifted local oscillator (LO) signals which modulates said baseband signal to a plurality of phase shifted intermediate frequency (IF) signals, wherein said plurality of phase shifted intermediate frequency signals are further modulated to a plurality of phase shifted radio frequency (RF) signals using a plurality of local oscillator (LO) signals generated by a second voltage controlled oscillator; or (b) a plurality of phase shifted local oscillator (LO) signals which modulates said baseband signal directly to said plurality of phase shifted radio frequency signals;

a plurality of power amplifiers that amplify said plurality of phase shifted radio frequency signals; and a plurality of antennas that radiate said plurality of phase shifted radio frequency signals for generating said phased array signals, wherein said phased array signals achieve (i) tilting of an antenna radiation plane of said plurality of antennas from an initial position to a tilted position and (ii) transmitting said plurality of phase shifted radio frequency signals in a circular polarization.

2. The smart antenna system of claim 1, wherein said circular polarization is achieved by (i) arranging a plurality of first phase array radiating elements in a horizontal plane in addition to a plurality of second phase array radiating elements in a vertical plane and (ii) feeding individual radiating elements of said plurality of first phase array radiating elements with exactly 90 degree phase shifted clocks with respect to said plurality of second phase array radiating elements.

3. The smart antenna system of claim 1, wherein said phased array signals (i) provide proper coverage to areas close to said plurality of antennas and (ii) provide down tilt for said antenna radiation plane to avoid interference between signals with other cell arrays.

4. The smart antenna system of claim 1, wherein said first voltage controlled oscillator (VCO) generates multiple phases of said plurality of phase shifted LO signals and said second voltage controlled oscillator generates said plurality of LO signals, wherein said multiple phases of said plurality of phase shifted LO signals from the first VCO modulate said baseband signal to generate at least one of (i) said plurality of phase shifted intermediate frequency signals and wherein said plurality of phase shifted intermediate frequency signals are further modulated to said plurality of radio frequency signals using said plurality of LO signals generated by the second VCO or (ii) said plurality of phase shifted radio frequency signals, wherein said multiple phases further comprise said quadrature clocks that are generated in said first voltage controlled oscillator.

5. The smart antenna system of claim 1, wherein said first voltage controlled oscillator and said second voltage controlled oscillator are either at least one of (i) a ring oscillator voltage controlled oscillator or (ii) an inductance-capacitance (LC) voltage controlled oscillator.

6. The smart antenna system of claim 5, wherein said ring oscillator voltage controlled oscillator (VCO) comprises a plurality of rings which are oscillating at fixed phase differences with respect to each other to generate said plurality of local oscillator (LO) signals that are phase shifted.

7. The smart antenna system of claim 1, wherein said antenna radiation plane is tilted using an electrical down tilt, wherein said electrical down tilt is a programmable tilt, wherein said electrical down tilt is achieved by programming the phase difference between (i) said plurality of phase shifted intermediate frequency signals or (ii) said plurality of phase shifted radio frequency signal that are sent to said second phase array radiating elements.

8. A smart antenna system for generating circularly polarized and electrically down tilted phased array signals, comprising:

a baseband transmitter that transmits a baseband signal;

a first voltage controlled oscillator (VCO), wherein said voltage controlled oscillator (VCO) generates of at least one of:

(a) a plurality of first clocks that are phase shifted which modulates said baseband signal to a plurality of phase shifted intermediate frequency signals, wherein said plurality of phase shifted intermediate frequency signals are further modulated to a plurality of phase shifted radio frequency (RF) signals using a plurality of second clocks that is generated by a second voltage controlled oscillator; or (b) a plurality of clocks that are phase shifted which modulates said baseband signal directly to said plurality of phase shifted radio frequency signals;

a plurality of power amplifiers that amplify a plurality of phase shifted radio frequency signals; and a plurality of antennas that radiate said plurality of phase shifted radio frequency signals for generating said phased array signals, wherein said phased array signals achieve (i) tilting of an antenna radiation plane of said plurality of antennas from an initial position to a tilted position, and (ii) transmitting said plurality of phase shifted radio frequency signals in a circular polarization, wherein said antenna radiation plane is tilted using an electrical down tilt, wherein said electrical down tilt is a programmable tilt, wherein said electrical down tilt is achieved by programming the phase difference between (i) said plurality of phase shifted intermediate frequency signals or (ii) said plurality of phase shifted radio frequency signals that are sent to a plurality of second phased array radiating elements.

9. The smart antenna system of claim 8, wherein said circular polarization is achieved by (i) arranging a plurality of first phase array radiating elements in a horizontal plane in addition to said plurality of second phase array radiating elements in a vertical plane and (ii) feeding individual radiating elements of said plurality of first phase array radiating elements with exactly 90 degree phase shifted clocks with respect to said plurality of second phase array radiating elements.

10. The smart antenna system of claim 8, wherein said second voltage controlled oscillator comprises a plurality of second clocks, wherein said plurality of second clocks modulate said plurality of phase shifted intermediate frequency signals to said plurality of phase shifted radio frequency signals.

11. A method for generating circularly polarized and electrically down tilted phased array signals, comprising:

transmitting, using a baseband transmitter, a baseband signal;

generating, using first a voltage control oscillator (VCO), at least one of (a) a plurality of first clocks that are phase shifted which modulates said baseband signal to a plurality of phase shifted intermediate frequency signals, wherein said plurality of phase shifted intermediate frequency signals are further modulated to a plurality of phase shifted radio frequency (RF) signals using a plurality of second clocks that is generated by a second voltage controlled oscillator; or (b) a plurality of clocks that are phase shifted which modulates said baseband signal directly to said plurality of phase shifted radio frequency signals;

amplifying, using a plurality of power amplifiers, said plurality of phase shifted radio frequency signals;

transmitting, using a plurality of antennas, said plurality of phase shifted radio frequency signals in a circular polarization; and tilting, using an electrical down tilt, an antenna radiation plane of said plurality of antennas using said phased array signals, wherein said phased array signals (i) provide proper coverage to areas close to said plurality of antennas and (ii) provide down tilt for said antenna radiation plane to avoid interference between signals with other cell arrays.

12. The method of claim 11, comprising:

arranging a plurality of first phase array radiating elements in a horizontal plane in addition to a plurality of second phase array radiating elements in a vertical plane; and feeding individual radiating elements of said plurality of first phase array radiating elements with exactly 90 degree phase shifted clocks with respect to said plurality of second phase array radiating elements to achieve said circular polarization.

13. The method of claim 11, wherein said first voltage controlled oscillator and said second voltage controlled oscillator are either at least one of (i) a ring oscillator voltage controlled oscillator or (ii) an inductance-capacitance (LC) voltage controlled oscillator.

14. The method of claim 13, wherein said ring oscillator voltage controlled oscillator comprises a plurality of rings that oscillate at fixed phase differences with respect to each other to generate multiple phases of a plurality of phase shifted local oscillator (LO) signals.

* * * * *